US009045695B2

(12) United States Patent
Brentnall et al.

(10) Patent No.: US 9,045,695 B2
(45) Date of Patent: Jun. 2, 2015

(54) APPARATUS AND METHOD FOR PYROLYSIS OF ORGANIC WASTE

(75) Inventors: Paul Wyatt Brentnall, Tadley (GB); John Clive Brownen, Lymington (GB)

(73) Assignee: THERMITECH SOLUTIONS LIMITED, Tadley, Hampshire (GB)

( * ) Notice: Subject to any disclaimer, the term of this patent is extended or adjusted under 35 U.S.C. 154(b) by 1249 days.

(21) Appl. No.: 12/530,581

(22) PCT Filed: Feb. 27, 2008

(86) PCT No.: PCT/GB2008/050132

§ 371 (c)(1),
(2), (4) Date: Jul. 2, 2010

(87) PCT Pub. No.: WO2008/110834

PCT Pub. Date: Sep. 18, 2008

(65) Prior Publication Data

US 2010/0282587 A1 Nov. 11, 2010

(30) Foreign Application Priority Data

Mar. 9, 2007 (GB) ..... 0704619.6

(51) Int. Cl.

| | |
|---|---|
| ***C10B 7/02*** | (2006.01) |
| ***C10B 43/14*** | (2006.01) |
| ***C10B 47/18*** | (2006.01) |
| ***C10B 47/34*** | (2006.01) |
| ***B08B 9/08*** | (2006.01) |
| ***F28F 19/00*** | (2006.01) |
| ***F28G 1/08*** | (2006.01) |
| *F28F 1/36* | (2006.01) |

(52) U.S. Cl.

CPC . *C10B 47/34* (2013.01); *C10B 7/02* (2013.01); *B08B 9/0808* (2013.01); *F28F 1/36* (2013.01); *F28F 19/008* (2013.01); *F28G 1/08* (2013.01)

(58) Field of Classification Search

CPC ..... C10B 7/02; C10B 7/10; C10B 47/34; C10B 47/44; B08B 9/0808; F28G 1/08; F28F 19/008

USPC ..... 201/2, 30, 32; 202/117, 118, 128, 241; 422/210; 165/91, 94, 95; 48/85.2

See application file for complete search history.

(56) References Cited

U.S. PATENT DOCUMENTS 1,650,191 A * 11/1927 Cotterman ..... 202/118
1,929,649 A * 10/1933 Pier et al. ..... 201/30

(Continued)

FOREIGN PATENT DOCUMENTS

WO WO-03/057800 7/2003
WO WO 2004/022673 * 3/2004

OTHER PUBLICATIONS

International Search Report mailed Aug. 11, 2008, directed to International Application No. PCT/GB2008/050132; 1 page.

(Continued)

*Primary Examiner* — Jill Warden
*Assistant Examiner* — Joye L Woodard
(74) *Attorney, Agent, or Firm* — Baker & Hostetler LLP

(57) ABSTRACT

A gasification reactor includes a wiper system including at least one wiper blade operable to wipe an interior surface of the reactor. A condenser unit of the gasification reactor includes a scraper system including at least one scraper segment operable to scrape an interior surface of the condenser unit.

7 Claims, 3 Drawing Sheets

(56) References Cited

U.S. PATENT DOCUMENTS

| | | | | | |
|---|---|---|---|---|---|
| 1,972,929 | A | * | 9/1934 | Fisher | 202/118 |
| 4,094,769 | A | * | 6/1978 | Brown | 202/118 |
| 4,123,332 | A | | 10/1978 | Rotter | |
| 4,235,676 | A | * | 11/1980 | Chambers | 202/118 |
| 4,412,889 | A | * | 11/1983 | Oeck | 202/117 |
| 4,618,735 | A | * | 10/1986 | Bridle et al. | 585/240 |
| 7,749,359 | B2 | * | 7/2010 | Flottvik | 202/118 |

OTHER PUBLICATIONS

G.V.C. Peacocke et al. (1994), "Ablative Plate Pyrolysis of Biomass for Liquids," *Biomass and Bioenergy*, 7(1-6): 147-154.

* cited by examiner

ENLARGED
DETAIL VIEW

ENLARGED DETAIL VIEW

APPARATUS AND METHOD FOR PYROLYSIS OF ORGANIC WASTE

REFERENCE TO RELATED APPLICATIONS

This application is the national stage under 35 USC 371 of International Application No. PCT/GB2007/050132, filed Feb. 27, 2008, which claims the priority of United Kingdom Application No. 0704619.6, filed Mar. 9, 2007, the entire contents of both of which prior applications are incorporated herein by reference.

FIELD OF THE INVENTION

The invention relates to apparatus and methods for waste management. In particular the invention relates to gasification (pyrolysis) of organic waste.

BACKGROUND OF THE INVENTION

There is an ever increasing amount of organic waste material produced in the world today. Managing the disposal of such waste in a safe and environmentally friendly manner and reclaiming any residual value in the waste is therefore a prime concern.

A known method for managing organic waste is through the process of pyrolysis, also known as gasification. Pyrolysis is the process of thermally degrading organic material in the absence of oxygen. This form of thermal degradation reduces waste volumes by converting the waste into ash so allowing easier disposal. What is more, pyrolysis can also produce organic fuels, such as hydrocarbon oils and gases, by way of by-product. The organic fuels may be reclaimed for other uses, thereby extracting value from the waste, or may be used to provide heat for the pyrolysis process itself, thereby making the process to some extent self-sustaining.

A known gasification apparatus, such as that disclosed in EP0851019, comprises two main components for the gasification process, namely a reaction chamber and a condenser unit. The reaction chamber is where the pyrolysis occurs, and the condenser unit, which is coupled to the reaction chamber, is where volatile hydrocarbons (e.g. oils and tar) liberated by the pyrolysis process are recovered.

In the known gasification apparatus, waste is fed through a rotating drum (the reaction chamber) containing a non-oxygen atmosphere. The drum is heated to a temperature of around 800° C. so that pyrolysis can take place. The drum is rotated to agitate the material so as to increase the pyrolytic efficiency, and also assist in the feeding of the material through the drum. This drum must, as far as possible, be free of oxygen for efficient pyrolysis to occur. However, this can be technically difficult to achieve in a rotating drum operating at relatively high temperature and with material continuously being fed into and out of the drum. Problems include sealing problems, lubrication problems and general reliability problems. Further problems with the known gasification apparatus are caused by oils and tar carried over from the reaction chamber (reactor) blocking the condensation unit. The condensation of the volatile hydrocarbon materials in the condensation unit impairs the efficiency of the condensation process and can lead to reliability and safety problems. There is therefore a need for an improved gasification apparatus and method.

SUMMARY OF THE INVENTION

It is an object of the present invention to overcome these and other problems associated with the prior art.

According to a first aspect of the present invention, there is provided a wiper system for a gasification reactor comprising at least one wiper blade operable to wipe an interior surface of the reactor.

Preferably, the or each wiper blade forms part of a wiper blade assembly. Preferably, the or each wiper blade assembly extends radially from a hub. Preferably, there is at least one hub mounted, preferably, fixedly mounted, on a rotatable shaft. The or each hub may be a central hub.

Preferably, the or each wiper blade assembly comprises a blade shaft and a blade. The or each blade shaft preferably extends radially from the central hub. The or each blade preferably has a long edge which is located adjacent to a wall of the reactor. Preferably, the or each blade is situated at a predetermined angle to the rotatable shaft, said angle being in the range from about 5° to about 50°.

Preferably, there is a small gap between the long edge of the or each blade and the reactor wall to allow for free movement of the blade along the wall of the reactor. The long edge of the or each blade is preferably spaced from the interior surface of the reactor.

The or each wiper blade assembly may be formed from a single piece of material. Alternatively, the or each wiper blade assembly may be formed from two or more sections of material.

Preferably, when the or each wiper blade assembly is formed from two or more sections of material, the sections are bonded together such that no relative movement of the sections is allowed.

Preferably, there is more than one hub fixed to the rotatable shaft.

Preferably, there are three wiper blade assemblies extending from each hub.

Preferably, the rotatable shaft defines a longitudinal axis of the gasification reactor.

Preferably, the wiper blade assemblies on each subsequent hub are staggered by a set radial angle, and overlap with each other along the longitudinal axis of the reactor. The staggering may be at an angle in the range of about 30° to about 50°, preferably, about 40°.

Preferably, the shaft, and the or each hub and wiper blade assembly are formed from heat resilient material. Examples of suitable heat resilient materials include, but are not limited to, stainless steels.

According to a second aspect of the present invention, there is provided a scraper system for a condenser unit of a gasification reactor comprising at least one scraper segment operable to scrape an interior surface of the condenser unit.

Preferably, the scraper system is adapted for use in a bundle type condenser unit.

Preferably, the or each scraper segment comprises at least one outwardly extending arm. Preferably, the at least one outwardly extended arm is adapted to abut a surface of a pusher plate assembly.

Preferably, the or each scraper segment comprises three outwardly extending arms. Preferably, the arms extend radially from the centre of the or each scraper segment.

Preferably, the or each scraper segment is adapted to encircle the outer circumference of a bundle tube in the condenser unit. Alternatively, the or each scraper segment is adapted to encircle a portion of the outer circumference of a bundle tube.

Preferably, the or each scraper segment has a circular cross-section. Preferably, the or each scraper segment has a radius slightly greater than that of a bundle tube, in order to allow free movement of the or each scraper segment over the length of a bundle tube.

Preferably, scraper segments encircle each bundle tube in the bundle type condenser. Preferably, there is one scraper segment per bundle tube.

Preferably, the pusher plate assembly comprises two pusher plates separated by a boss. The pusher plates preferably comprise holes to accommodate each of the bundle tubes in the condenser. Preferably, the holes have a larger diameter than the bundle tubes to allow free movement of the pusher plates over the tubes.

Preferably, the or each scraper segment is located to encircle at least a portion of the outer circumference of a bundle tube, between the two pusher plates.

The arms of the or each scraper segment preferably extend radially beyond the circumferences of the holes in the pusher plates. This allows the arms of the or each scraper segment to abut the pusher plate, and ensures that the or each scraper segment can not travel through the holes of the pusher plates.

Preferably, the or each scraper segment and the pusher plate assembly are formed from heat resilient material. Examples of suitable materials include stainless steels.

According to a third aspect of the present invention, there is provided a method of operation of a gasification reactor comprising the steps of:

a) introducing solid waste material into the reactor;
b) heating the reactor to pyrolyse the waste material in the reactor;
c) agitating the waste material in the reactor using at least one wiper blade; and
d) cooling the gaseous product of the pyrolysis reaction in a bundle type condenser.

Preferably, the method of operation of the gasification reactor comprises the further step of cleaning bundle tubes in the bundle type condenser using at least one scraper segment.

The invention extends to a gasification reactor having a wiper system of the first aspect of the invention.

The invention further extends to a condenser unit of a gasification reactor having a scraper system of the second aspect of the invention.

All of the features described herein may be combined with any of the above aspects, in any combination

BRIEF DESCRIPTION OF THE DRAWINGS

For a better understanding of the invention, and to show how the same may be carried into effect, reference is now made by way of example to the accompanying drawings in which.

DETAILED DESCRIPTION OF THE INVENTION

Figures 1A, 1B:
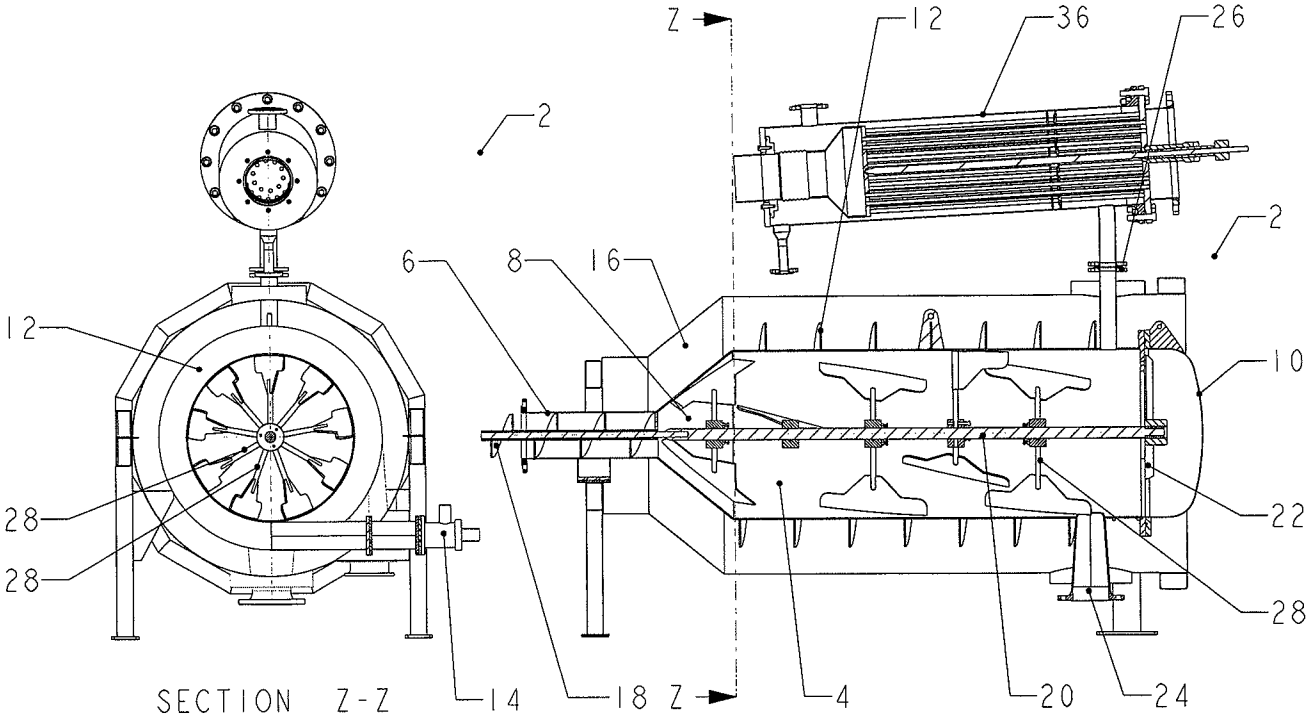
FIG. 1*a* shows a schematic, transverse view of a gasification apparatus according to an embodiment of the invention.
FIG. 1*b* shows a cross sectional view of the gasification apparatus of FIG. 1*a* along the line Z-Z.

Referring to FIGS. 1*a* and 1*b* a gasification apparatus (gasifier) according to an embodiment of the invention has a longitudinal axis, which in normal use is aligned substantially parallel to a horizontal plane.

The gasifier comprises a reactor component 2 which in turn comprises a cylindrical tube 4 made of a heat resistant material. This tube 4 is approximately 600 mm in diameter and approximately 2000 mm in length. At one end of the reactor is a feeding tube 6 that is approximately ⅙ the diameter of the reactor 2. A cone shape 8 made of a heat resistant material acts as a transition from the feed tube 6 to the main reactor tube 4. A removable convex end portion 10, located at the opposite end of the reactor 2 to the feed tube 6, forms an air tight seal to the reactor 2. The feed tube 6, cone 8, reactor tube 4 and convex end 10 are all concentric to one another.

Around the outer circumference of the reactor tube 4 is a heat transfer channel 12. The heat transfer channel 12 spreads heat applied to the reactor surface to form an even heating of the reactor tube 4 surface. The heat transfer channel 12 is formed from a helical sheet of heat resistant material that is perpendicular to the axis of the reactor 2 and forms a helical path starting at the reactor cone 8 and finishing at the convex end 10.

In use, a source of heat 14 is applied to the reactor 2 at one end of the helical shaped heat transfer channel 12, and the entrained hot gas flows along the channel 12 so evenly heating the reactor tube surface 4.

The reactor 2 and heat transfer channel 12 are extensively lagged by an oven casing 16 to ensure minimal heat loss from the system, and to form an enclosure over the heat transfer channel 12.

A feed auger 18 consists of a variable pitch auger mounted along the axis of the reactor 2 that, when operated in a rotational movement, will transfer the solid waste material longitudinally along the inside of the feed tube wall 6 towards the reactor cone 8.

A wiper shaft 20 is formed from a cylindrical shaft made of a heat resistant material. The wiper shaft 20 is supported at either end by means of a bearing mounted in the feed auger 18 shaft and a bearing holder 22 located and fixed to the opposite end of the reactor. The wiper shaft 20 is free to rotate independently of the feed auger 18 so each can be operated at different rotational speeds. The wiper shaft 20 is concentric to both ends of the reactor 2.

An ash gate 24 is provided at the lowest point on the circumference of the reactor wall 4. The ash gate 24 allows ash and char to be ejected from the system.

A gas outlet 26 is also provided in the reactor 2. The gas outlet 26 consists of a pipe made of a heat resistant material which is positioned at the highest point on the circumference of the reactor wall 4, towards the convex end of the reactor 2. The gas outlet 26 provides an exit point for gas produced during the pyrolysis reaction.

Figure 2:
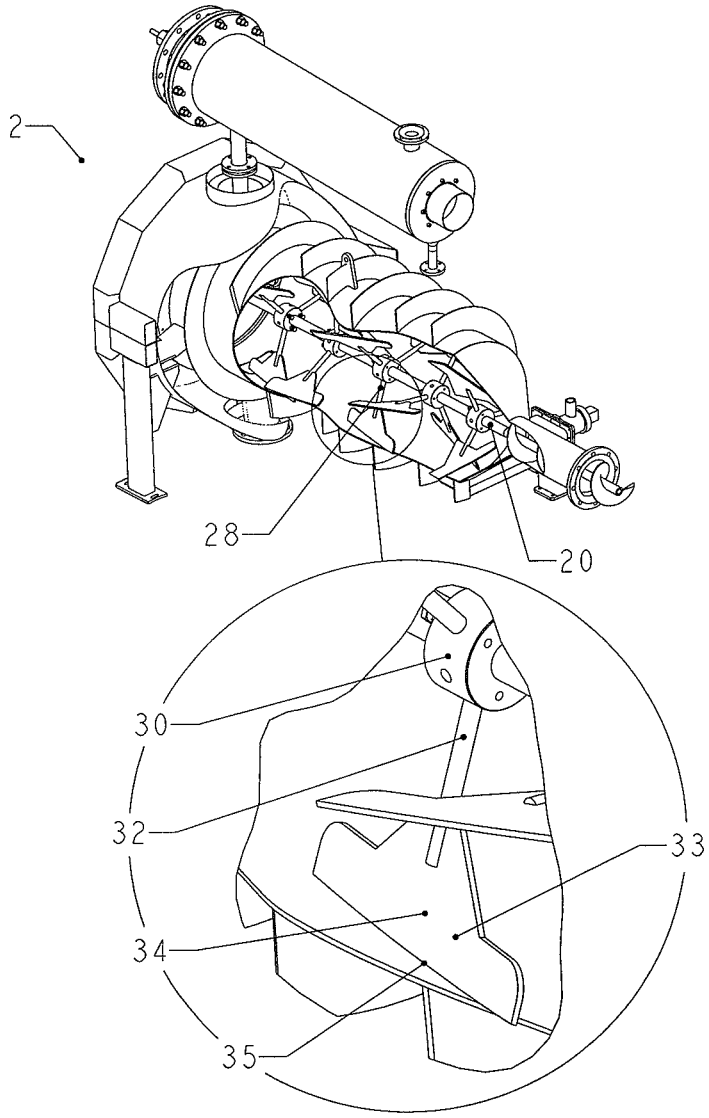
FIG. 2 shows a schematic perspective cutaway view of the gasification apparatus of FIG. 1*a* and an enlarged detailed view of a portion thereof.

Referring now to FIG. 2, to the wiper shaft 20 are attached a number of wiper blade assemblies 28. Each wiper blade assembly 28 consists of a wiper hub 30 which is attached to the wiper shaft 20, such that no longitudinal or radial movement is allowed with reference to the wiper shaft 20. The wiper hub 30 is made of a heat resistant material.

A number of wiper blade shafts 32 are attached to the wiper hub 30. These wiper blade shafts 32 are made of a heat resistant material and protrude from the wiper hub 30 in a radial direction towards the circumference of the outer reactor wall 4.

Attached to each wiper blade shaft 32, at the opposite end of its mounting to the wiper hub 30, is a wiper blade 34. The wiper blade 34 is formed from a piece of heat resistant material which is positioned such that a long edge 35 of the wiper blade 34 is presented at a predetermined angle to the longitudinal axis of the wiper shaft 20, and a flat surface 33 of the wiper blade 34 is presented radially to the wiper shaft 20. The long edge 35 of the wiper blade 34 is situated such that, at its predetermined angle to the longitudinal reactor axis, it presents a straight edge to the wall and will allow minimal variation of gap between the blade 34 and the reactor wall 4; this gap is typically approximately 2 mm. The gap between the blade 34 and the reactor wall 4 has the effect that when a rotational movement is applied to the wiper shaft 20 the wiper blade assembly 28 rotates within the reactor vessel 2 and the wiper blade 34 maintains a constant clearance along the circumference of the reactor wall 4.

A number of wiper blade assemblies 28 are fixed to the wiper shaft 20. Each wiper blade assembly 28 is staggered by a predetermined radial angle from its predecessor on the shaft. This can be seen in FIG. 1*b*.

Generally, there are three wiper blades 34 per hub 30 and their corresponding wiper bade shafts 32. This number however, could increase or decrees depending on operational situations. Also, generally, the wiper blade assembly 28 is made of 3 separate components, but in other embodiments the whole assembly could be formed from one component or any number of components.

Figure 3:
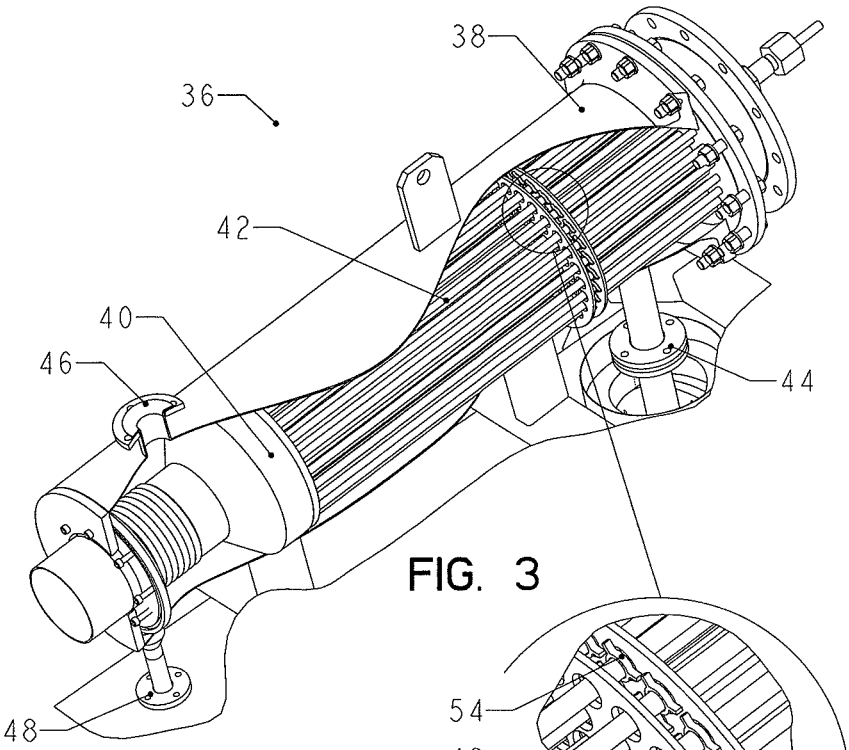
FIG. 3 shows a schematic perspective cutaway view of a condensing unit of the gasification apparatus of FIG. 1*a;*

Referring to FIG. 3, a gasification reactor 2 comprises a scraped condenser 36. The scraped condenser 36 consists of a main body 38 which is constructed of a heat resistant material and fully encases a condenser bundle 40. A condenser bundle 40 consists of a number of bundle tubes 42 of typically ¼0th the diameter of the encasing main body 38. The bundle tubes 42 are arranged such that there is no contact between the tubes 42, and such that there is a similar radial spacing between each bundle tube 42. The bundle tubes 42 are also arranged in the same longitudinal orientation as the outer casing 38. The length of the complete assembly is approximately 1000 mm.

A gas inlet 44 is located at one end of the condenser 36 and provides an entry point for the gas. A gas exit point 46 is provided at the opposite end of the condenser 36 to the gas inlet 44, at the highest point on the circumferential wall of the main body 38. A condensed oil outlet 48 is provided at the lowest point on the circumferential wall of the main body 38, at the opposite end of the condenser 36 to the gas inlet 44.

Figure 4:
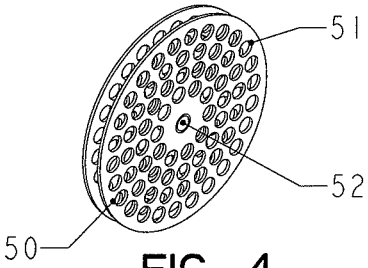
FIG. 4 shows a schematic perspective view of a pusher plate of the condensing unit of the gasification apparatus of FIG. 1*a;*

Referring now to FIG. 4, a pusher assembly consists of two pusher plates 50. The pusher plates 50 are made of a heat resistant material and have a flat surface comprising circular holes 51. The holes 51 are typically ⅓rd larger in diameter than a single condenser bundle tube 42. The holes 51 are arranged such that they correspond to the positions of the bundle tubes 42 in the condenser tube bundle 42. This makes it possible to move the plate 50 longitudinally along the condenser tube bundle 40 without contacting the surface of any of the condenser bundle tubes 42. A pusher boss 52 is constructed of a heat resistant material and acts as a spacer between two pusher plates 50 thus maintaining a constant gap of typically ½5th the diameter of the pusher plate 50 between the two plates 50. The pusher plate 50 is constructed of 3 components, but in further embodiments of the invention, the pusher plate assembly could be constructed out of one component or a number of components.

Figure 5:
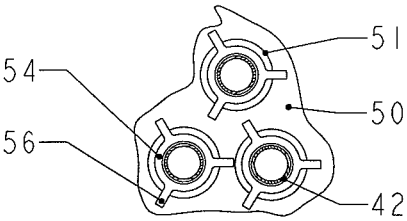
FIG. 5 shows a schematic end view of a portion of the condensing unit of FIG. 4.

Referring to FIG. 5, the scraped condenser 36 comprises a scraper segment 54 which is constructed of a heat resistant material. The scraper segment 54 is shaped such that it encompasses a single condenser bundle tube 42, but allows typically a 0.5 mm radial gap around the circumference of the tube 42. The gap allows movement of the scraper segment 54 longitudinally along the tube 42. The scraper segment 54 has a number of radially producing arms 56 which extend beyond the radius of the corresponding hole 51 in the pusher plate 50, so the scraper segment 54 cannot pass through the hole 51.

Figure 6:
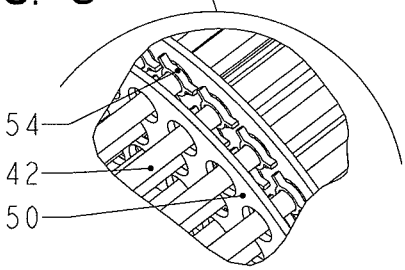
FIG. 6 shows a schematic perspective view of a portion of the condensing unit of the gasification apparatus of FIG. 1.

FIG. 6 shows an enlarged view of the scraper segments 54 assembled in the scraped condenser assembly 36. The scraper segment 54 is contained within the pusher plate assembly, such that when the two pusher plates 50 are driven longitudinally along the condenser tube bundle 42, one of the plates 50 will abut the arms 56 of the scraper segment 54 and drive it along the condenser bundle tube 42 which it encompasses. When the direction of the pusher plate assembly is reversed, the arms 56 of the scraper segment 54 will abut the second pusher plate 50, and the scraper segment 54 will change direction along the longitudinal axis of the scraped condenser 36.

Figure 7:
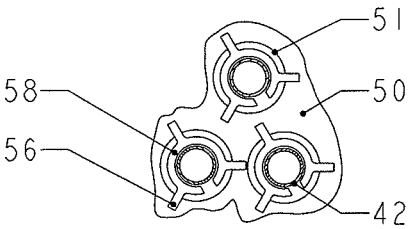
FIG. 7 shows a schematic end view of a portion of a condensing unit of a gasification apparatus according to a further embodiment of the invention.

Referring new to FIG. 7, a second embodiment of the invention uses a scraper segment 58. The scraper segment 58 still includes the arms 56 to abut the scraper plates 50, but now only partially encompasses the condenser bundle tube 42.

In use, the reactor walls 4 are raised to a temperature of between approximately 600° and 900° Celsius to ensure there is enough energy for the pyrolysis reaction to take place. Heating is achieved by applying a heat source 14 to the start of the heat transfer channel 12, with a fan used to entrain the heated gas along the heat transfer channel 12. The heated gas leaves the heat transfer channel 12 at the end of the reactor 2 where it is vented to the atmosphere. Solid waste material is fed into the reactor by means of a feed station (not shown) to feed tube 6 which provides the waste in an oxygen free state to the feed auger 18 shown in FIG. 1*a*. On entry to the reactor 2, the solid waste material is picked up by a rotating wiper blade assembly 28 and moved along the circumference of the inner reactor wall 4. Due to the inclined angle of the wiper blades 34 to the wiper shaft 20, the solid waste also travels longitudinally along the inner wall of the reactor 2. The next wiper blade 34 assembled to the wiper shaft 20 longitudinally overlaps its predecessor so the travel of the waste along the reactor wall 4 is continued along the array of wiper blade assemblies 28.

As the solid waste material travels along the heated reactor wall 4, a pyrolysis reaction takes place and hydrocarbon gas and evaporated hydrocarbon oils are released into the volume of the enclosed reactor 2. The residual ash and char continue to travel along the reactor wall 4 by the means of the wiper system 28. The last wiper assembly 28 in the array is positioned so the last ⅓rd of the blade 34 travels over the opening of the ash gate 24 so ejecting the ash and char from the system. This ash and char is then removed from the reactor 2 by an auger and air lock device (not shown).

The helical movement along the reactor wall 4 allows the waste material maximum resonance time against the heated reactor surface 4. The released gas and evaporated oil then exits the reactor chamber via the reactor 2 gas outlet 26 and enters the condenser 36 gas inlet 44.

The hydrocarbon gas and evaporated oil that has been released from the pyrolysis reaction enters the condenser 36 via the gas inlet pipe 44. The gas and entrained oils contact the cooled bundle tubes 42 of condenser bundle 40 and, as cooling takes place, the oil condenses on the bundle tubes 42. It is this process of deposition which eventually leads to clogging of the condenser 36. The longitudinal movement of the scraper segments 54 on the condenser bundle tubes 42 stops the formation of these oil deposits, ensuring the reliable operation of the condenser 36.

The separated oil leaves the condenser via the oil removal pipe 48. The cooled gas leaves the process via the gas exit pipe 46. The cooled gas is then cleaned via additional processes to enable it to be either be stored for further use, or used as fuel in steam or electrical generation.

The wiper blade assemblies in the gasification reactor of the present invention allow the solid waste material to remain in close contact with the heated reactor walls whilst travelling along the length of the reactor. This ensures a more efficient pyrolysis reaction than prior art rotating drum reactors. Thus, the pyrolysis process according to the present invention reduces the waste volume to a greater extent than traditional pyrolysis reactions.

Further, the scraper system in the condensation reactor maintains a more efficient condensation process, because it prevents the build up of condensed oils and tar on the condensation tubes. This ensures the hot gas from the pyrolysis reaction is able to come into contact with the cooled condensation tubes and condense thereon.

The scraper system also ensures that the oil and tar by-products from the pyrolysis reaction are effectively removed from the reactor so that they can be disposed of safely.

Attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

The invention claimed is:

1. A method of operation of a gasification reaction comprising:

introducing solid waste material into a gasification reactor having a longitudinal axis substantially parallel to a horizontal plane;

heating the reactor to pyrolyse the waste material in the reactor;

agitating the waste material in the reactor using wiper blades of at least three staggered wiper blade assemblies; and cooling the gaseous product of the pyrolysis reaction in a bundle type condenser, wherein the wiper blades of the wiper blade assemblies are provided on adjoining hubs which are spaced from each other along the longitudinal axis and wherein the wiper blades of the wiper assemblies are staggered by predetermined different radial angles relative to a longitudinal axis of the reactor and are staggered relative to each other when viewed from an end of the rotatable shaft and overlapping with each other along the longitudinal axis of the reactor, and wherein each wiper has a long edge that is oriented relative to the longitudinal axis of the reactor such that an angle of orientation of each long edge to the longitudinal axis is an oblique angle of about 5° to about 50°.

2. The method of claim 1, further comprising cleaning bundle tubes in the bundle type condenser using at least one scraper segment.

3. A wiper system for a gasification reactor, comprising:

a rotatable shaft having a longitudinal axis substantially parallel to a horizontal plane, a plurality of hubs mounted on the rotatable shaft, and at least three wiper blade assemblies each mounted on respective hubs, each wiper blade assembly comprising at least one wiper blade and being operable to wipe an interior surface of the reactor;

wherein the wiper blade assemblies extend radially from the hubs, and wherein the wiper blades of the wiper blade assemblies are provided on adjoining hubs which are spaced from each other along the longitudinal axis and wherein the wiper blades of the wiper assemblies are staggered by predetermined radial angles relative to the longitudinal axis of the reactor and are staggered relative to each other when viewed from an end of the rotatable shaft and overlap with each other along the longitudinal axis of the reactor and wherein wherein each wiper has a long edge that is oriented relative to the longitudinal axis such that an angle of orientation of each long edge to the longitudinal axis is an oblique angle of about 5° to about 50°.

4. The wiper system according to claim 3, wherein the hub is a central hub.

5. The wiper system according to claim 3, wherein three wiper blade assemblies extend from each hub.

6. The wiper system according to claim 3, wherein the rotatable shaft defines the longitudinal-axis of the gasification reactor.

7. A wiper system for a gasification reactor having a longitudinal axis aligned substantially parallel to a horizontal plane, comprising:

a rotatable shaft, a plurality of hubs which are spaced from each other along the longitudinal axis and mounted on the rotatable shaft, and a plurality of wiper blade assemblies each mounted on the respective hubs, each wiper blade assembly comprising at least one wiper blade comprising a long edge and being operable to wipe an interior surface of the reactor;

wherein the wiper blade assemblies extend radially from the hubs, and wherein the long edge of each wiper blade is oriented relative to the longitudinal axis such that an angle of orientation of the long edge to the longitudinal axis is an oblique angle of about 5° to about 50° wherein the wiper blades of the wiper assemblies are staggered relative to each other when viewed from an end of the rotatable shaft.

* * * * *